US005884885A

United States Patent [19]

Schmidt, Jr.

[11] Patent Number: 5,884,885

[45] Date of Patent: Mar. 23, 1999

[54] CRADLE ASSEMBLY

[76] Inventor: Anthony P. Schmidt, Jr., 11753 Terra Bella Blvd., Plantation, Fla. 33325

[21] Appl. No.: 683,797

[22] Filed: Jul. 18, 1996

[51] Int. Cl.[6] ..... A47G 29/00

[52] U.S. Cl. ..... 248/346.01; 114/259; 248/371; 248/346.06; 248/647; 248/640

[58] Field of Search ..... 248/647, 671, 248/146, 371, 398, 346.03, 346.06, 346.07, 346.01, 640, 641, 642; 108/1, 3; 114/258, 263, 344, 259; 405/3

[56] References Cited

U.S. PATENT DOCUMENTS

| | | | |
|---|---|---|---|
| 2,013,542 | 9/1935 | Nordmark | 108/3 |
| 4,565,343 | 1/1986 | Lake, Jr. et al. | 248/346.06 |
| 4,934,647 | 6/1990 | Edwards | 248/346.06 X |
| 5,022,707 | 6/1991 | Beauvais et al. | 248/371 X |
| 5,054,739 | 10/1991 | Wallin | 248/371 X |
| 5,445,353 | 8/1995 | Sakamoto | 248/371 X |
| 5,584,535 | 12/1996 | Jacobson et al. | 248/371 X |
| 5,622,348 | 4/1997 | Stechly | 248/371 |

*Primary Examiner*—Peter M. Cuomo
*Assistant Examiner*—Stephen Vu

[57] ABSTRACT

A transverse cradle assembly comprises at least one pair of a set of cradle assemblies. The set of assemblies is mirror imaged. Each assembly comprises an upper cradle and a lower cradle having a slot therein for mutually and oppositely securing a slidable locking block having an incline. The upper and lower cradles are pivotally joined together at one end. As a device is loaded onto the set of assemblies, the slidable locking block moves along the slots to correspond with the loading of the device. When suitable weight is applied to the ends of the upper cradles, the upper cradle slot engages the incline on the block thus locking it into place. The cradle assembly is secured to a mounting slide and may further be secured onto a platform if desired.

8 Claims, 2 Drawing Sheets

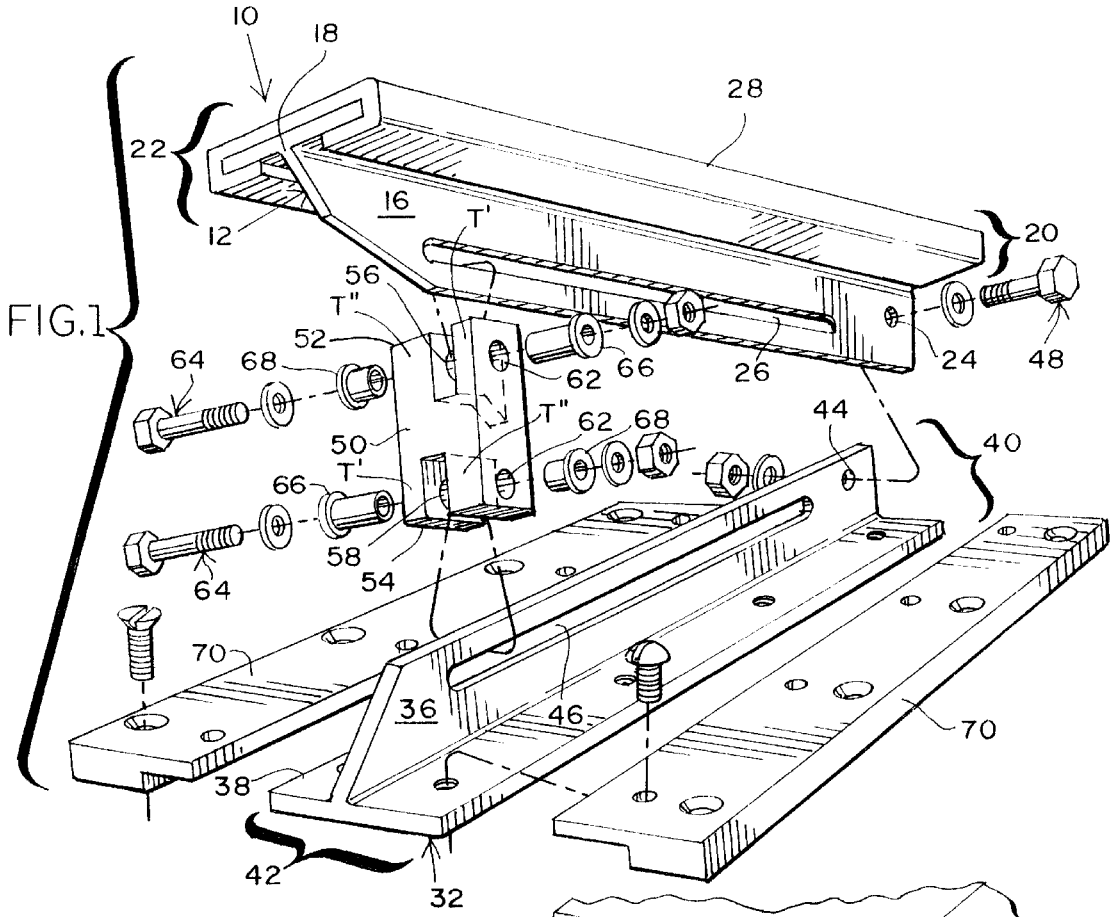
FIG.1
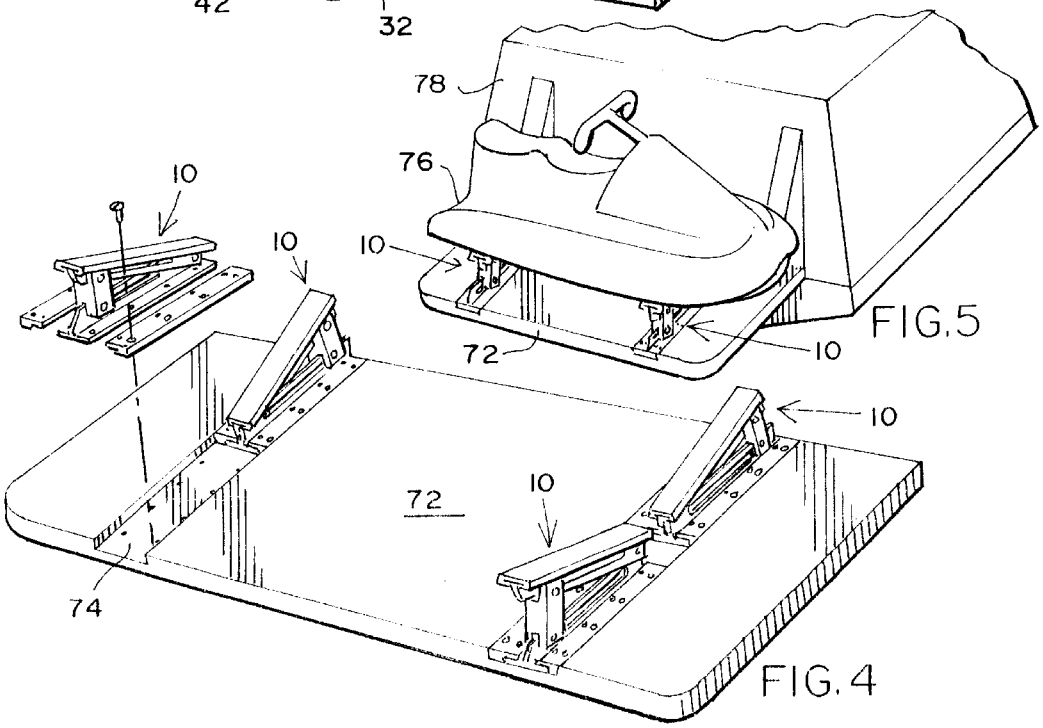
FIG.5
FIG.4

CRADLE ASSEMBLY

FIELD OF THE INVENTION

The present invention relates to a transverse cradle assembly. More specifically, the present cradle assembly permits a device or devices to rest thereon and has the capability of locking into place at the location of maximum stability for the device or devices.

BACKGROUND OF THE INVENTION

Cradle assemblies and the like are well know in the arts for holding and storing devices that can rest thereon. In the marine industry, such devices are employed to cart and tow marine vessels to and from the water, dry docking areas, maintenance and repair locations, etc. These devices are typically constructed of a pair of opposed cradles. A marine vessel may be urged between, and ride upon, these opposed cradles which are fastened to a boat trailer. The cradles usually are secured along the length of the boat trailer and thus, are parallel to the keel of the marine vessel. In this fashion, the opposed edges of the vessel's bottom are in physical contact with the cradles. The vessel is then secured onto the cradle assembly by mechanical means such as by tying its bow to the trailer.

Difficulties and disadvantages of these prior art marine cradle assemblies are evident from their construction. First, there is the cost of length-intensive cradles, which are typically manufactured of a non-corrosive metal. A second disadvantage of the prior art results from the angular configuration of a vessel's bottom as the present cradles only come into contact with the edges of that bottom. A third problem is well known in that these devices are generally pivotally connected to their bases (or trailers) which results in a less than satisfactorily stabilized cradle assembly. Other disadvantages are known throughout the industry.

SUMMARY OF THE INVENTION

In order to overcome the aforementioned disadvantages of the prior art, the present invention encompasses a transverse cradle assembly for carrying, carting and storing devices thereon. The transverse cradle assembly comprises at least one pair of a set of cradle assemblies. The set of assemblies is mirror imaged. Each assembly comprises an upper cradle and a lower cradle having a slot therein for mutually and opposedly securing a slidable locking block having an incline. The upper and lower cradles are pivotally joined together at one end. As a device is loaded onto the set of assemblies, the slidable locking block moves along the slots to correspond with the loading of the device. When suitable weight is applied to the ends of the upper cradles, the upper cradle slot engages the incline on the block thus locking it into place. The cradle assembly is secured to a mounting slide and may further be secured onto a platform if desired.

It is therefore an object of the present invention to provide for a transverse cradle assembly.

It is still another object of the present invention to provide for a cradle assembly that, as applied to vessels, can secure the said vessels thereon along the keel of the vessel in a transverse manner.

It is yet another object of the present invention to provide for a self locking cradle assembly.

Other objects and features of the novel transverse cradle assembly will become apparent when viewed in connection with the accompanying drawing and written description.

BRIEF DESCRIPTION OF THE DRAWINGS

The features embodying the present invention are illustrated in the accompanying drawing, forming a part of this application, in which:

FIG. 1 is a diagrammatic view of the present invention with hardware shown;

FIG. 4 is a perspective view of a pair of cradle assembly sets secured to a platform as taught by the invention; and, FIG. 5 is a perspective end view of a marine vessel with a personal water bike trailered onto the present invention.

DETAILED DESCRIPTION OF A PREFERRED EMBODIMENT

Figure 2:
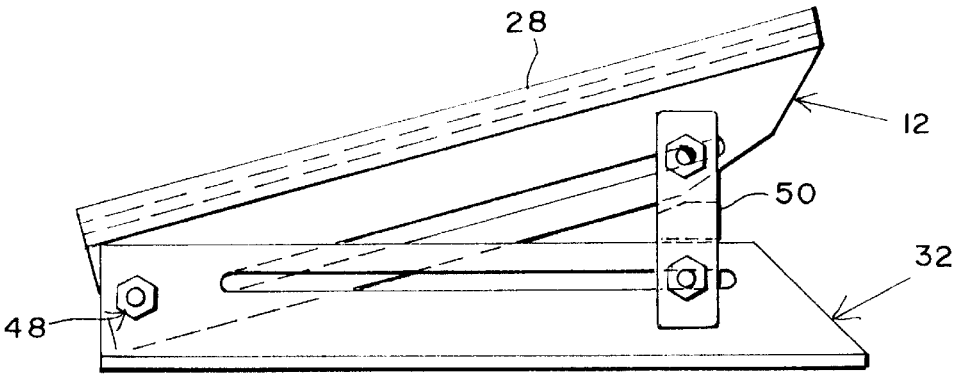
FIG. 2 is a side view of the present invention shown with the slidable locking block in an unlocked position.

A detailed description of a preferred embodiment of the present invention is shown in FIG. 1. Therein, cradle assembly 10 comprises an upper cradle 12 and a lower cradle 32. The upper and lower cradles each have a substantially cross-sectional "T" shape. The cradles, 12 and 32, may be manufactured of any high-strength material such as steel. However, if the cradle assembly 10 is to be applied to the marine industry, a rust inhibiting material, such as aluminum, stainless steel or brass, should be employed in the construction of the cradles.

Upper cradle 12 has as its "T" shape a latitudinal component 16 and a perpendicular longitudinal component 18. Though length dimensions may vary accordingly to the particular purpose to which the cradle assembly 10 is to be applied, the preferred length of upper cradle 12 is approximately fourteen inches. Cradle 12 has a proximal end 20 and a distal end 22. The proximal end 20 of the latitudinal component 16 of the upper cradle 12 has an aperture 24 for mating with a similar aperture of the lower cradle 32 hereinbelow described. Further, the upper cradle 12 houses a slot 26 that runs substantially across the latitudinal component 16.

On top of the longitudinal component 18 of upper cradle 12 is a preformed molding 28 having substantially a "C" shape. The molding may be manufactured of any cushioning material having a high strength such as rubber or a similar poly synthetic component.

Lower cradle 32 of cradle assembly 10 is also shaped like the capital letter "T" with a vertical component 36 and a perpendicular horizontal component 38. Though length dimensions may vary accordingly to the particular purpose to which the cradle assembly 10 is to be applied, the preferred length of lower cradle 32 is approximately fourteen inches. Lower cradle 32 has a proximal end 40 and a distal end 42. The proximal end 40 of the vertical component 36 of the lower cradle 32 has an aperture 44 for mating with the aperture 24 of the upper cradle 12. Further, the lower cradle 32 houses a slot 46 that runs substantially across the vertical component 36.

Upper cradle 12 and lower cradle 32 of cradle assembly are adjoined pivotally and cantileverly at their respective apertures, 24 and 44, by a bolt-washer-cap nut assembly 48. The makeup of assembly 48 needs to correspond with its environment. Thus, if the environment of the cradle assembly 10 within a marine application, then the assembly 48, as well as other hardware, must be rust protective.

Locking block 50 generally comprises a rectangular shape. Locking block 50 has an upper end 52 and a lower end 54. A square cut channel 56 is made into the upper end 52 of locking block 50, and an offset opposed square cut channel 58 is made into the lower end 54 of locking block

50. An additional incline 60, better seen in FIGS. 2A and 3A, is cut into the channel 56 of upper end 52. The angle of incline 60 should be at least 30 degrees relative to the base of channel 56, but may have an angular range of 25 to 45 degrees. Apertures 62 are cut through the surface of the locking block 50 and through the channels, 56 and 58, respectively. It is preferred, with respect to the depth of the channels, that the apertures 60 be centered between the channel base and the channel top.

Locking block 50 is slidably secured to the cradle assembly 10. Means for securing the locking block 50 to the cradle assembly 10 comprise bolt-washer-bushing-bushing-washer-cap nut assemblies 64 inserted through the apertures 62 of locking block 50 and through slots 26 and 46. Of assemblies 64, it is important to note that the two bushings are of unequal length.

As the channels 56 and 58 are offset, a result is that one wall of each channel is thinner, T', than the other wall, T", of the locking block 50. A longer bushing 66 is inserted into the aperture 62 located about the thinner channel wall and comes to rest within the aperture 62 of the thicker channel wall. The shorter bushing 68 is then inserted into the aperture 62 nearest the thicker channel wall and abuts the end of the first, longer bushing 66. It is preferred that the bushings 66 and 68 by manufacture of nylon or some other similarly situated plastic have corresponding frictional coefficients. The remainder of the hardware assembly 64 should, again, correspond in makeup with the environment to which the cradle assembly 10 is to be used.

The cradle assembly 10 is secured to a base (not shown in FIG. 1) by securing mounting slides 70 to the vertical component 36 of lower cradle 32, and further securing the mounting slides 70 to a base. As shown in FIGS. 4 and 5, cradle assembly 10 is shown in a pair of two sets secured to a diving platform base 72. The cradle assemblies 10 are faced proximal end to proximal end in a transverse relation to that of the platform 72. For better fit and finish, a groove 74 may be cut into the base 72 so that the sets of assemblies 10 are flush with the top of the platform 72. FIG. 5 depicts a typical use of the cradle assembly 10 as a trailer for a personal water bike 76 attached to a marine vessel 78.

Figure 3:
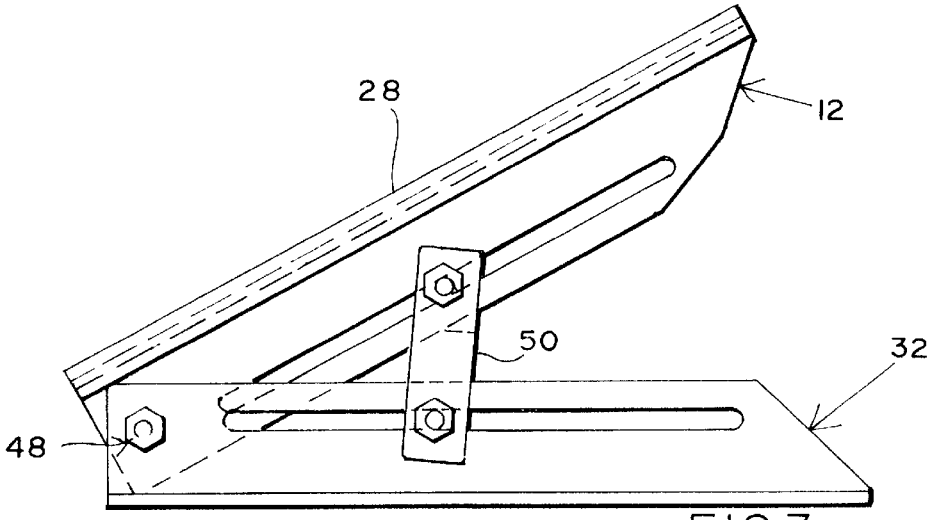
FIG. 3 is a side view of the present invention shown with the slidable locking block in a locked position.
Figure 2A:
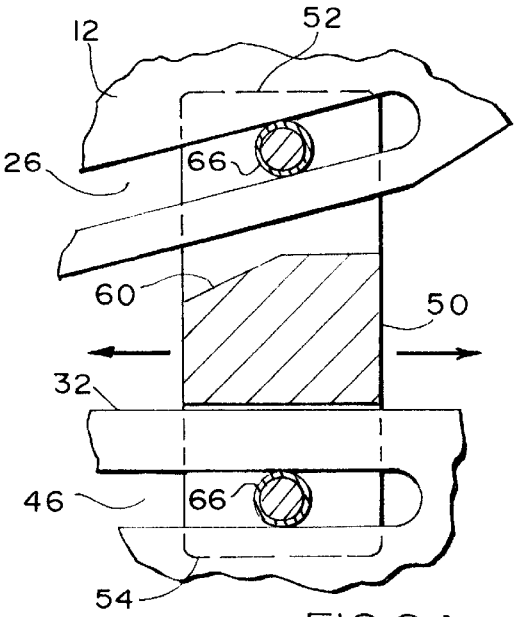
FIG. 2A is a fragmented view of the locking block of FIG. 2.
Figure 3A:
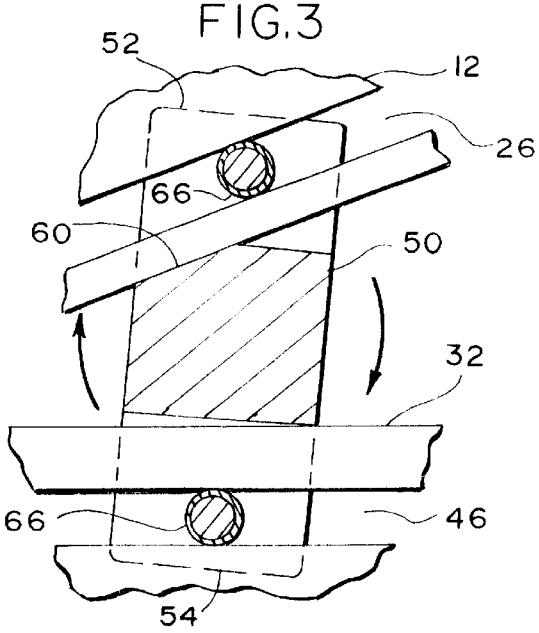
FIG. 3A is a fragmented view of the locking block of FIG. 3.

Referring now to FIGS. 2 and 2A, and 3 and 3A for the operation of the cradle assembly 10, two relative positions are shown; FIGS. 2 and 2A show the locking block 50 in an unlock, slidable position relative to the upper cradle 12 and the lower cradle 32, and FIGS. 3 and 3A show the locking block 50 in its locked position. As a device, such as a water craft 76, is loaded upon the cradle assembly, its weight will shift from the proximal end 20 of the upper cradle 12 to the distal end 22 of the upper cradle 12. As this occurs, the locking block slides toward the distal ends 22 and 42 of cradle assembly 10 (FIGS. 2, 2A). When enough weight of the device 76 is displaced from the proximal end 20 to the distal end 22, incline 60 allows the locking block 50 to tilt towards the distal end 22 thus locking the block 50 in place.

It is intended that the description of the preferred embodiments of this invention is illustrative only. Other embodiments of the invention that are within the scope and concept of this invention are herein included with this application.

What is claimed is:

1. A cradle assembly comprising, in combination:

an ypper cradle and a lower cradle each having a substantially rectangular shaped longitudinal component defining a generally beveled corner at a first end and a straight corner at a second end, wherein said ends have an elongated slot extending in between and a flat support surface perpendicular to each of said respective components;

a slidable locking block having a weight activated locking mechanism;

means for securing said locking block through said elongated slots, and;

means for pivotally secured said upper crakle directly to said lower cradle in a contilever relation, whereby said contilever relation comprises said first ends to be free moving by defining various vertical inclined positions between the upper crakle with respect to the lower cradle as the slidable locking block adjustably moves along both said elongated slots, and said second ends are to be fixed.

2. The cradle assembly as defined in claim 1, wherein said upper and lower cradles have a substantially "T" shape.

3. The cradle assembly as defined in claim 2, said T-shaped upper cradle has an upper latitudinal component with a molding situated thereon.

4. The cradle assembly as defined in claim 1, wherein said assembly further comprises a base and mounting slides for securing said lower cradle transversely to said base.

5. A plurality of cradle assembly sets, wherein each set comprises and upper cradle and a lower cradle each having a substantially rectangular shaped longitudinal component defining a generally beveled corner at a first end and a straight corner at a second end, wherein said ends have an elongated slot extending in between and a flat support surface perpendicular to each of said repective components, means for pivotally and cantileverly securing said cradles directly to one another forming a proximal end and a distal end for said sets, such that said proximal end of each of said cradle assembly sets faces one another when secured to a platform, a slidable locking block in a slidable relation to said crakle assembly sets, and wherein the cantilever relation beteween the upper cradle and the lower cradle comprises said first ends to be free moving by defining various vertical inclined positions between the upper cradle with respect to the lower cradle as the slidable locking block adjustably moves along both said elongated slots, andsaid second ends are to be fixed.

6. The cradle assembly sets as defined in claim 5, wherein said sets have two cradle assemblies.

7. A platform, having a length, for carrying a water craft for application in a marin environment comprising a base having mounting means comprising two channeled slides perpendicularly secured to the length of said platform such that two cradle assemblies are secured to each of said channeled slides and to said platform, each od said cradle assemblies being forme of an upper cradle and lower cradle, wherein each haveing a substantially rectangular shaped longitudinal component defining a generally beveled corner at a first end and a straight corner at a second end, wherein said ends have an elongated slot extending in between and a flat support surface perpendicular to each of said respective components, means for pivotally and directly connecting together said cradles for cantilever operation, a slidable locking block having a locking mechanism activated by the weight of said water craft, means for securing said locking block to each of said assemblies, and wherein the cantilever operation between the upper cradle and the lower cradle comprises said first ends to be free moving by defining various vertical inclined positions between the upper cradle with respect to the lower cradle as the slidable locking block adjustably moves along both said elongated slots, and said second ends are to be fixed.

8. The platform as defined in claim 7, wherein each of said assemblies has a proximal end in order for said upper and lower cradle to be pivotally connected, such that said two assemblies are positioned onto said mounting means with said proximal ends adjacent to one another.

* * * * *

UNITED STATES PATENT AND TRADEMARK OFFICE

CERTIFICATE OF CORRECTION

PATENT NO. : 5,884,885

DATED : March 23, 1999

INVENTOR(S) : Anthony P. Schmidt, Jr.

It is certified that error appears in the above-indentified patent and that said Letters Patent is hereby corrected as shown below:

In Claim 1, line 2, substitute --upper-- for "ypper"; in line 13, substitute --securing-- for "secured" and substitute --cradle-- for "crakle; in line 17, substitute --cradle-- for "crakle".

In Claim 5, line 13, substitute --cradle-- for "crakle".

In Claim 7, line 2, substitute --marine-- for "marin"; in line 6, substitute --of-- for "od"; line 7, substitute --formed-- for "forme"; line 8, substitute ---having-- for "haveing".

In Claim 5, line 14, substitute --between-- for "beteween"; in line 18, substitute --and said-- for "andsaid".

Signed and Sealed this

Second Day of November, 1999

*Attest:*

*Attesting Officer*

Q. TODD DICKINSON

*Acting Commissioner of Patents and Trademarks*